United States Patent [19]

Harman et al.

[11] Patent Number: 4,481,802

[45] Date of Patent: Nov. 13, 1984

[54] METHOD OF PEENING THE INSIDE OF A SMALL DIAMETER TUBE

[75] Inventors: Douglas G. Harman; Ralph E. Lambert, both of Tampa, Fla.

[73] Assignee: Westinghouse Electric Corp., Pittsburgh, Pa.

[21] Appl. No.: 297,901

[22] Filed: Aug. 31, 1981

[51] Int. Cl.[3] ..... B21J 5/00

[52] U.S. Cl. ..... 72/53

[58] Field of Search ..... 72/53, 40; 51/332, 334, 51/337

[56] References Cited

U.S. PATENT DOCUMENTS

| | | | |
|---|---|---|---|
| 2,423,992 | 7/1947 | Nordgren | 51/334 |
| 2,549,043 | 4/1951 | Arthur | 51/334 |
| 3,648,498 | 3/1972 | Voss | 72/53 |
| 3,696,563 | 10/1972 | Rands | 51/332 |
| 3,834,200 | 9/1974 | Winter | 72/53 |
| 3,857,750 | 12/1974 | Winter | 72/53 |
| 3,871,139 | 3/1975 | Rands | 51/334 |
| 4,230,426 | 10/1980 | Avery | 72/53 |

*Primary Examiner*—Gene P. Crosby

*Attorney, Agent, or Firm*—F. J. Baehr, Jr.

[57] ABSTRACT

A method for peening a portion of the inside of a small diameter heat exchanger tube by inserting a rotating shaft having a peening strip affixed thereto, orbiting and reciprocating the shaft as it rotates, and maintaining this operation for a predetermined length of time to relieve residual tensile stresses in a portion of a tube installed in a heat exchanger.

7 Claims, 1 Drawing Figure

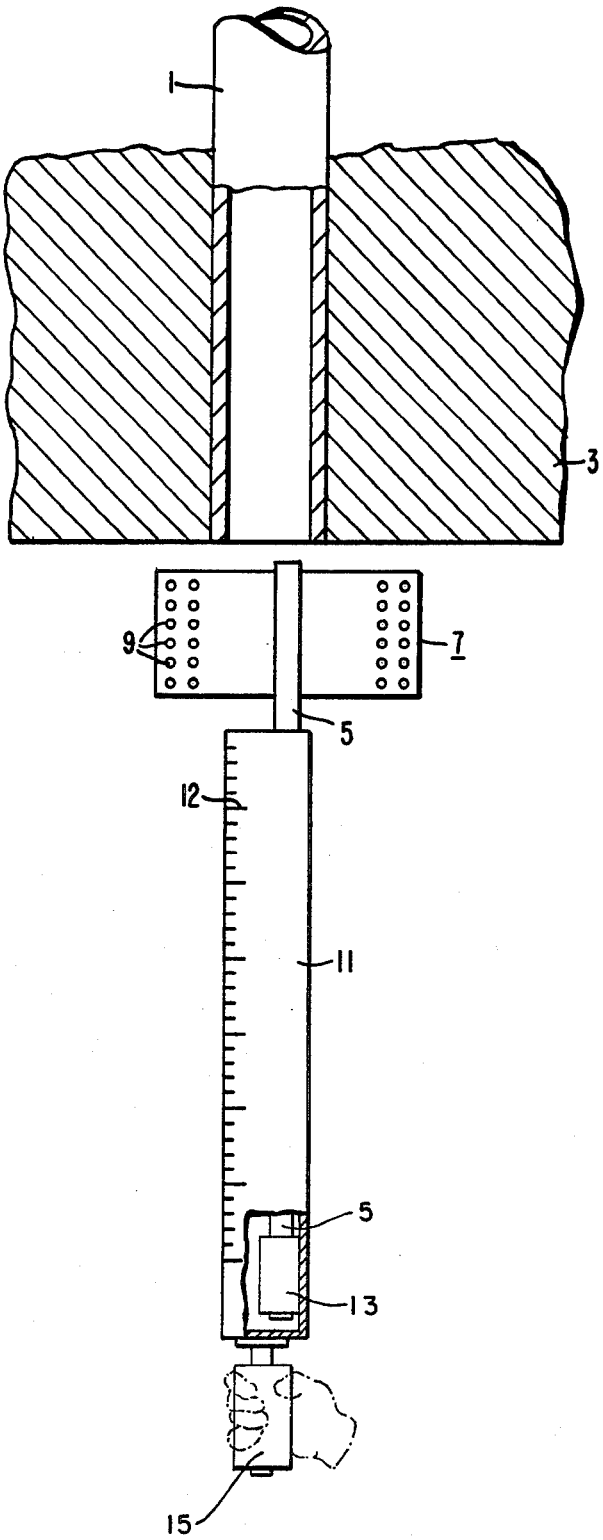
1
3
9
7
5
12
11
5
13
15

METHOD OF PEENING THE INSIDE OF A SMALL DIAMETER TUBE

BACKGROUND OF THE INVENTION

This invention relates to heat exchangers and more particularly to a method for peening a portion of the inside of a small diameter heat exchanger tube to relieve stresses.

Heat exchanger tubes are assembled in heat exchanges and then are held in place by light rolling of the tube in the tubesheet holes. The tubes then have their ends seal welded to the tubesheet and are expanded into engagement with the tubesheet the full depth of the tubesheet. All of these operations are carried out in a manner which minimizes residual tensile stresses. However, such stresses become locked in the tubes when there are severe surface irregularities in the holes, in the tubesheet, or if the tubes are inadvertently deformed in any of the above-mentioned installation procedures. These residual stresses cause premature failure of the tubes unless they are relieved or lowered.

SUMMARY OF THE INVENTION

In general a method for peening the inside of a small diameter tube when performed in accordance with this invention comprises the steps of inserting a shaft having a peening strip affixed thereto in the tube, rotating the shaft at a high speed, orbiting the shaft at a relatively slow speed as it rotates, maintaining a predetermined minimum clearance between the orbiting shaft and the tube, reciprocating the shaft over a predetermined distance at a slow rate, and continuing the above-mentioned steps for a predetermined period to relieve stresses in a portion of the tube.

BRIEF DESCRIPTION OF THE DRAWING

The objects and advantages of this invention will become more apparent from reading the following detailed description in conjunction with the accompanying drawing, in which:

The sole FIGURE is a partial sectional view of a tube and a peening device made in accordance with this invention.

DESCRIPTION OF THE PREFERRED EMBODIMENT

Referring now to the sole FIGURE in detail there is shown apparatus utilized in a method for stress relieving a portion of a small diameter heat exchanger tube 1 disposed in a tubesheet 3, the apparatus comprises a rotating shaft 5 having affixed thereto a peening strip 7 formed from a phenolic ribbon with spherical tungsten carbide shot 9 by way of the peening strip 7 permanently attached thereto adjacent the distal margins of the ribbon, the radial distance from the axis of the shaft 5 to the shot 9 being greater than the inside diameter of the tube 1. The shaft 5 is rotatably and eccentrically disposed in a generally cylindrical housing 11 which fits into the tube 1. The housing 11 has indicia 12 disposed thereon to reference the location of the peening strip 7 with respect to the end of the tube 1. A variable speed motor 13 is connected to one end of the shaft 5, the end opposite the end having the peening strip affixed thereto. An orbiting drive is provided for orbiting shaft 5 in the tube 1. The orbiting drive includes a motor 15 which is attached to the one end of the housing 11 to rotate the housing between 30 and 100 revolutions per minute causing the shaft to orbit at the same rate.

The method for peening the inside of a small diameter tube comprises the steps of:

manually inserting the shaft 5 having a peening strip 7 affixed thereto into the tube 1 a depth indicated by the indicia 12 which places the peening strip 7 adjacent a portion of the tube which is to be stress relieved;

rotating the shaft at high speed generally between 2000 and 4000 revolutions per minute to provide the proper peening action;

orbiting the shaft 5 as it rotates at a speed of about 30 to 100 revolutions per minute;

maintaining a predetermined minimum clearance between the rotating shaft 5 and the tube by inserting the housing 11 in the tube 1 and holding the housing 11 therein to maintain the proper clearance of the shaft 5 with respect to the tube 1 as the shaft 5 orbits within the tube 1, this clearance being generally about 45 to 50 thousandths of an inch when a shot size of 40 thousandths is utilized;

reciprocating the shaft at the rate of about one stroke a minute, the length of the stroke being determined by the portion of the tube to be peened as indicated by the indicia 12 disposed on the housing 11;

continuing the above-mentioned steps for a predetermined period generally for about four minutes to obtain the proper amount of peening to relieve residual stresses in a portion of the tube.

The time and speed of rotating the shaft varies depending upon whether the portion to be peened is contained within the tubesheet or is beyond the tubesheet. The latter requires a slower rotating speed and a longer peening time.

What is claimed is:

1. A method of peening the inside of a portion of a tube comprising the steps of:

inserting into the tube a shaft having a peening strip affixed to one end thereto, the peening strip having shot so disposed thereon that the distance between the shot and the axis of the shaft by way of the peening strip is greater than the inner diameter of the tube so that peening occurs in the area diametrically opposite the location of the shaft as well as the area adjacent thereto;

rotating said shaft at high speed;

orbiting said shaft at a relatively slow speed as it rotates;

maintaining a predetermined minimum clearance between the orbiting shaft and the tube;

manually locating the peening strip a predetermined distance in the tube;

manually reciprocating the shaft over a predetermined distance; and continuing the above-mentioned steps for a predetermined period to relieve residual stresses in a portion of the tube.

2. The method as set forth in claim 1 and further comprising the step of utilizing a peening strip having shot which is generally 40,000th of an inch in diameter.

3. The method as set forth in claim 1, wherein the shaft is rotated generally between 2,000 and 4,000 revolutions per minute.

4. The method as set forth in claim 1, wherein the shaft is orbited at the rate of about 30 to 100 revolutions per minute.

5. The method as set forth in claim 1, wherein the minimum clearance between the orbiting shaft and the tube is generally maintained between 45 and 50 thousandths of an inch.

6. The method in claim 1, wherein the shaft is generally reciprocated at a rate of about one reciprocation per minute.

7. The method as set forth in claim 1, wherein the peening generally continues for a period of about four minutes.

* * * * *